US005383011A

United States Patent [19]

Numagami et al.

[11] Patent Number: 5,383,011

[45] Date of Patent: Jan. 17, 1995

[54] CLEANING DEVICE, PROCESS CARTRIDGE INCORPORATING THE CLEANING DEVICE, AND IMAGE FORMING APPARATUS USING THE CLEANING DEVICE

[75] Inventors: Atsushi Numagami, Hadano; Hiroyuki Shirai, Tokyo; Takeo Shoji, Yokohama, all of Japan

[73] Assignee: Canon Kabushiki Kaisha, Tokyo, Japan

[21] Appl. No.: 913,343

[22] Filed: Jul. 15, 1992

[30] Foreign Application Priority Data

Jul. 19, 1991 [JP] Japan ..... 3-179541
Jun. 1, 1992 [JP] Japan ..... 4-140572

[51] Int. Cl.[6] ..... G03G 21/00
[52] U.S. Cl. ..... 355/298; 355/299
[58] Field of Search ..... 355/299, 200, 260, 298, 355/210, 215

[56] References Cited

U.S. PATENT DOCUMENTS 4,264,191 4/1981 Gerbasi et al. ..... 355/299
4,530,594 7/1985 Adachi ..... 355/299
4,540,268 9/1985 Toyono et al. ..... 355/210
5,138,394 8/1992 Watanabe et al. ..... 355/298

FOREIGN PATENT DOCUMENTS 1-185587 7/1989 Japan ..... 355/299

*Primary Examiner*—Matthew S. Smith
*Assistant Examiner*—Shuk Y. Lee
*Attorney, Agent, or Firm*—Fitzpatrick, Cella, Harper & Scinto

[57] ABSTRACT

A cleaning device for cleaning the surface of an image carrier has a cleaning member for removing residual developer from the surface of the image carrier, a developer receiving reservoir for receiving the developer removed by the cleaning means, and at least one partition member partitioning the space inside the receiving reservoir and arranged such that the end of the partition member facing the image carrier is constructed to suppress accumulation of the developer thereon. With this cleaning device, it is possible to reduce the likehood of any cleaning failure and, hence, to improve the quality of the image.

22 Claims, 12 Drawing Sheets

CLEANING DEVICE, PROCESS CARTRIDGE INCORPORATING THE CLEANING DEVICE, AND IMAGE FORMING APPARATUS USING THE CLEANING DEVICE

BACKGROUND OF THE INVENTION

1. Field of the Invention

The present invention relates to a cleaning device, a process cartridge incorporating the cleaning device, and an image forming apparatus which uses the cleaning device or the process cartridge incorporating the cleaning device.

In this specification, the term "image forming apparatus" is used to mean various types of apparatuses capable of forming images, including copying machines, laser beam printers, word processors and facsimile apparatuses.

2. Description of the Related Arts

Hitherto, various types of cleaning devices have been proposed and used for the purpose of removing residual or waste toner from an electrophotographic photosensitive member of an image forming apparatus, for example by means of a cleaning member.

Such a cleaning device can be constructed as an independent unit or can be incorporated in a cartridge having a photosensitive member, developing unit, and other components. In each of these cases, residual toner removed and collected by a cleaning member, such as an elastic blade or brush, is collected in a receiver or reservoir through an opening which is formed in the vicinity of the photosensitive member. A practical example of such a cleaning device is shown in FIGS. 18, 19, and 20. FIGS. 18 and 19 are a side elevational view and a plan view of a cleaning device, respectively, while FIG. 20 is an enlarged view of encircled portion denoted by reference character F in FIG. 19.

The cleaning device generally denoted by reference numeral 101 has an opening formed in the front wall of the housing 102 which faces the photosensitive drum 106. An elastic blade 103 serving as a cleaning member is disposed at the upper side of the opening, i.e., at the downstream side of the opening as viewed in the direction of movement of the surface of the photosensitive drum 106. A guide member 104 for guiding the removed developing agent is disposed at the lower side of the opening, i.e., upstream of the opening as viewed in the direction of the movement of the photosensitive drum 106. Thus, the upper and lower ends of the front opening of the housing 102 are defined by the lower end of the cleaning member 103 and the upper end of the guide member 104.

In operation, the photosensitive drum 106 is rotated in the direction of the arrow by a driving means (not shown). A latent image forming means and a developing means (both not shown) are arranged around the photosensitive drum 106 so as to form a latent image on the photosensitive drum 106 and then to develop the latent image into a visible image. The thus developed image is transferred to a transfer member 108 by means of a transfer corona charger 107. Any residual developer 109 on the photosensitive drum 106 is removed by the cleaning member 103 of the cleaning device 101 and is guided into the housing via the above-mentioned opening so as to be collected in a collecting reservoir formed by the housing. The developing agent 105 is accumulated in the reservoir until the next maintenance operation, or transported by a screw conveyor or the like to a developer waste container provided in the cleaning device 101. In some cases, the collected developer is returned to the developing device for further use. In any case, a considerable amount of collected developer is held in the collecting reservoir following a cleaning operation. Therefore, the problem is encountered that when the cleaning device is dismounted for a preventive maintenance and happens to be tilted, the developer may spill from the reservoir through the above-mentioned opening so as to contaminate the apparatus and the environment. Developer waste usually exhibits small fluidity so that the developer is not completely leveled even when the reservoir is set again to a horizontal posture. This problem is serious, particularly in process cartridges having cleaning devices therein, because the cleaning device has to be frequently removed and then inserted again for recovery operations in situations of jamming. The unleveled state of developer in the collecting reservoir may hamper the transfer of the developer removed from the photosensitive drum into the reservoir. For instance, the collected developer may be accumulated locally in the region near the opening so that further collection is impeded even though there still is an ample, vacant space in the reservoir.

In view of these drawbacks in the prior art, the present applicant has developed an apparatus in which partition plates 100 are provided in a housing defining a developer collecting reservoir so as to divide the space inside the reservoir into a plurality of sections as shown in FIG. 19, thereby limiting the movement of the developer 105 in the longitudinal direction of the cleaning member. The apparatus is discussed in U.S. Pat. No. 4,530,594 which issued on Jul. 23, 1985.

Conventionally-used developers exhibit sufficiently high fluidity due to the comparatively large sizes of particles. In recent years, however, developers having smaller particle sizes have been used, in order to cope with the demand for higher quality images. The use of such fine developer poses the following problem when the developer is used in combination with the developer collecting reservoir of the type shown in FIG. 19. Namely, in such a situation, the developer 5 introduced into the reservoir tends to be deposited and accumulated on a flat portion G (see FIG. 20) of the partition plate 100 near the entrance for the developing agent. The developer waste thus accumulated hampers further introduction of developer waste into the collecting reservoir. Consequently, the developer waste 105 is forced into the nip between the photosensitive drum 106 and the elastic blade 103 or undesirably remains on the photosensitive drum 106, resulting in a degradation of the image quality.

SUMMARY OF THE INVENTION

Accordingly, an object of the present invention is to provide a cleaning device having improved cleaning performance, as well as a process cartridge incorporating such a cleaning device, and an image forming apparatus using the cleaning device or the process cartridge.

Another object of the present invention is to provide a cleaning device which provides a smooth flow of developer collected from an image carrier, as well as a process cartridge incorporating such a cleaning device, and an image forming apparatus using the cleaning device or the process cartridge.

Still another object of the present invention is to provide a cleaning device which can smoothly collect developer, as well as a process cartridge incorporating such a cleaning device, and an image forming apparatus using the cleaning device or the process cartridge.

A further object of the present invention is to provide a cleaning device which can further improve the quality of the image, as well as a process cartridge incorporating such a cleaning device, and an image forming apparatus using the cleaning device or the process cartridge.

To these ends, according to the present invention, there is provided a cleaning device for cleaning the surface of an image carrier comprising: cleaning means for removing residual developer from the surface of the image carrier; developer receiving means for receiving the developer removed by the cleaning means; and at least one partition member partitioning the space inside the receiving means and arranged such that the end of the partition member facing the image carrier is constructed to suppress accumulation of the developer thereon.

In addition, according to the present invention, there is provided a process cartridge adapted to be detachably mounted on an image forming apparatus comprising an image carrier and a cleaning device as set forth in the preceding paragraph.

Further according to the present invention, there is provided an image forming apparatus comprising a process cartridge as above-described; means for mounting the process cartridge; and conveyor means for conveying a recording medium.

Yet further according to the present invention, there is provided an image forming apparatus for forming an image on a recording medium, comprising: an image carrier; image forming means for forming an image on the image carrier; cleaning means for removing any residual developer after transfer of an image formed by the developer on the image carrier from the image carrier to the recording medium; developer receiving means for receiving the residual developer removed by the cleaning means; and at least one partition member partitioning the space inside the receiving means and arranged such that an end of the partition member facing the image carrier is constructed to suppress accumulation of the residual developer thereon.

Still further according to the present invention, there is also provided a cleaning device, comprising: a collecting reservoir for receiving matter collected from an object to be cleaned; and at least one movement limiting member provided in the collecting reservoir and being capable of suppressing movement of the received matter in the collecting reservoir. The movement limiting member has a cross-sectional area progressively decreasing towards the object to be cleaned.

Further according to another embodiment of the invention, there is provided a collecting reservoir for receiving matter collected from an object to be cleaned; and at least one movement limiting member provided in said collecting reservoir and being capable of suppressing movement of the received matter in said collecting reservoir. At least an end portion of said movement limiting member adjacent the object to be cleaned is made of a material having a small coefficient of friction.

The above and other objects, features and advantages of the present invention will become apparent from the following description of the preferred embodiments taken in conjunction with the accompanying drawings.

DESCRIPTION OF THE PREFERRED EMBODIMENTS

Preferred embodiments of the present invention will be described below with reference to the accompanying drawings.

Figure 1:
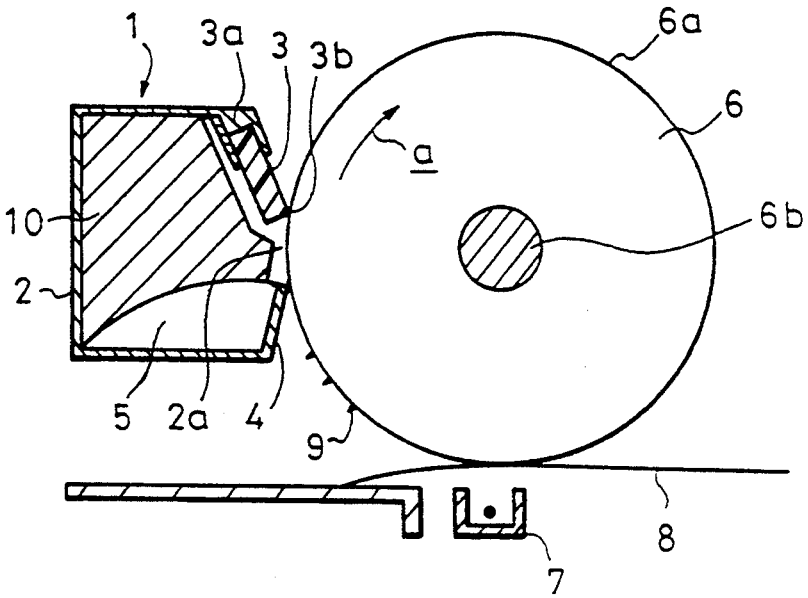
FIG. 1 is a fragmentary, sectional view of an electrophotographic apparatus incorporating a cleaning device embodying the present invention.

Referring first to FIG. 1, there is shown, in schematic fragmentary sectional view, an image forming apparatus incorporating a cleaning device which is a first embodiment of the present invention. The image forming apparatus incorporates a photosensitive drum 6 which is coated on its peripheral surface with a photosensitive material **6*a* and which rotates clockwise, i.e., in the direction of arrow a, as viewed in FIG. 1 about the axis of a shaft 6*b*. The cleaning device, generally denoted by 1, has a housing 2 which is provided with an opening 2*a* at its portion facing the photosensitive drum 6. The housing 2 is disposed along a generating line parallel with the axis of the photosensitive drum 6. An elastic cleaning blade 3 is held by a holder 3*a* which is formed in an upper portion of the housing 2 such that the elastic cleaning blade 3 is disposed above the opening 2*a***. The cleaning blade 3 extends from the holder 3*a* in a direction substantially opposite to the direction of arrow a of rotation of the photosensitive drum 6, such that an edge 3*b* of the cleaning blade 3 resiliently contacts the peripheral surface 6*a* of the photosensitive drum 6. Any developer remaining on the photosensitive drum 6 after transfer of an image therefrom is scraped off the drum 6 by the cleaning blade 3. The cleaning blade 3 is preferably made of a synthetic rubber such as silicone, urethane, nitrile, neoprene, and perfluoroethylene, or a natural rubber. Preferably, the hardness of the material of the cleaning blade ranges from 30° to 90° in terms of JISA hardness. The materials mentioned above are only illustrative and various other materials can be used as the material of the cleaning blade 3.

The cleaning device 1 further has an elastic guide member 4 which is disposed upstream of the blade 3 as viewed in the direction of rotation of the photosensitive drum 6. The guide member 4 has one end which lightly contacts the peripheral surface 6*a* of the photosensitive drum 6 at a level below the cleaning blade 3. The arrangement is such that developer remaining on the surface 6*a* of the photosensitive drum 6 is allowed to pass through the nip between the guiding member 4 and the drum 6 so as to be conveyed towards the cleaning blade 3 but the developer scraped off the surface 6*a* of the photosensitive drum 6 by the cleaning blade 3 is collected by and guided to a location remote from the surface 6*a* of the photosensitive drum 6, i.e., into a reservoir defined by the housing 2. The reference numeral 2, therefore, is also used to denote the reservoir. The developer, thus guided, is received and accumulated in the reservoir as depicted by the area denoted by 5.

Figure 2:
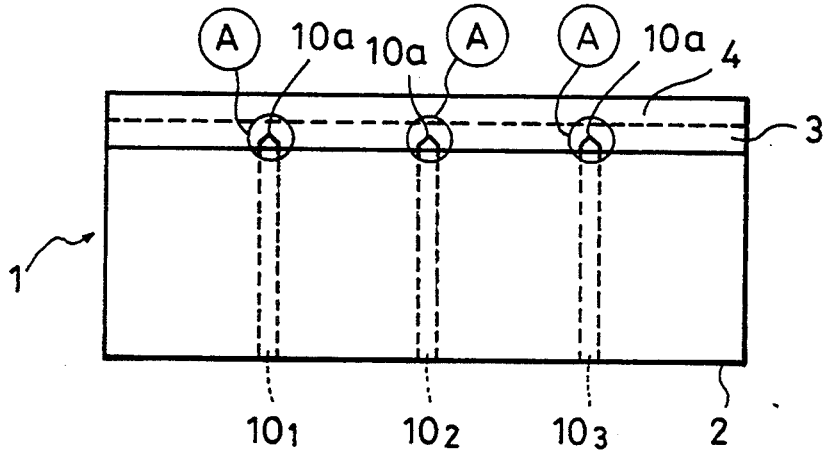
FIG. 2 is a plan view of the cleaning device.

Referring also to FIG. 2, a plurality of partition plates $10_1$, $10_2$ and $10_3$ (collectively denoted by reference numeral 10) are disposed in the reservoir 2, such that each of the partition plates 10 extends in a direction which crosses the axis of rotation of the photosensitive drum. In the illustrated embodiment, three partition plates 10 are employed to divide the space inside the reservoir 2 into four sub-spaces, thereby limiting movement of the developer 5 in the direction of the longitudinal axis of the cleaning blade 3.

Figure 3:
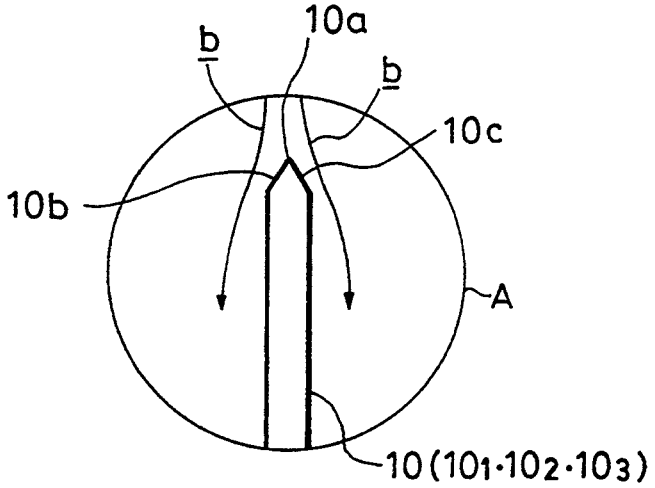
FIG. 3 is an enlarged view of a portion A shown in FIG. 2.

FIG. 3 is an enlarged view common to each of the portions marked by reference character A in FIG. 2. Arrows b indicate the flow of a toner powder being used as the developer. In this embodiment, the end 10*a* of each of the partition plates 10 facing the photosensitive drum 6 is gradually thinned towards the photosensitive drum 6. More specifically, both side surfaces of the partition plate 10 are tapered at their end portions as denoted by 10*b* and 10*c* so as to progressively reduce the thickness of the partition plate 10, thus ensuring smooth introduction of the developer into the reservoir 2. The angles of tapers of the side surfaces 10*b*, 10*c* are suitably determined so as not to allow accumulation or deposition of the developer on the end of the partition plates facing the photosensitive drum 6.

In this embodiment, the developer introduced into the reservoir is allowed to smoothly flow along the tapered side surfaces 10*b*, 10*c* of the partition plates 10 so as to be received in the reservoir 2 without accumulating in the entrance region. It is thus possible to efficiently and smoothly collect the developer waste scraped from the photosensitive drum 6.

Figure 4:
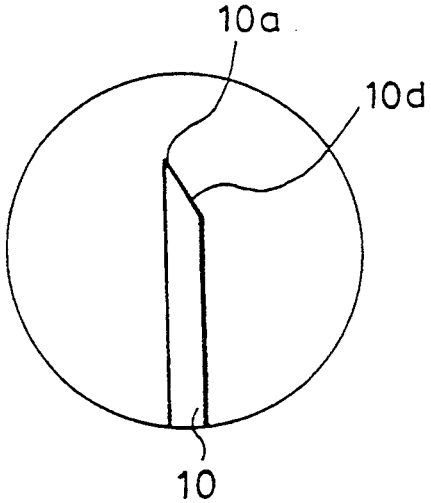
FIG. 4 is an enlarged view of an end portion of an example of a partition member.

FIG. 4 shows an alternative form of the end of the partition plate 10 used in the cleaning device of the present invention. It will be seen that the partition plate 10 is tapered only at its one side as at 10*d*, thus providing a thinned edge 10*a* facing the photosensitive drum 6. It will be seen that the partition plate 10 shown in FIG. 4 produces an effect equivalent to that produced by the partition plate shown in FIG. 3.

A second embodiment will be described with reference to FIGS. 5, 6 and 7.

In the drawings showing the second embodiment and subsequent embodiments of the invention, components or parts which are the same as, or equivalent to, those of the first embodiment are denoted by the same reference numerals as those used in FIGS. 1 through 4 showing the first embodiment.

Figure 5:
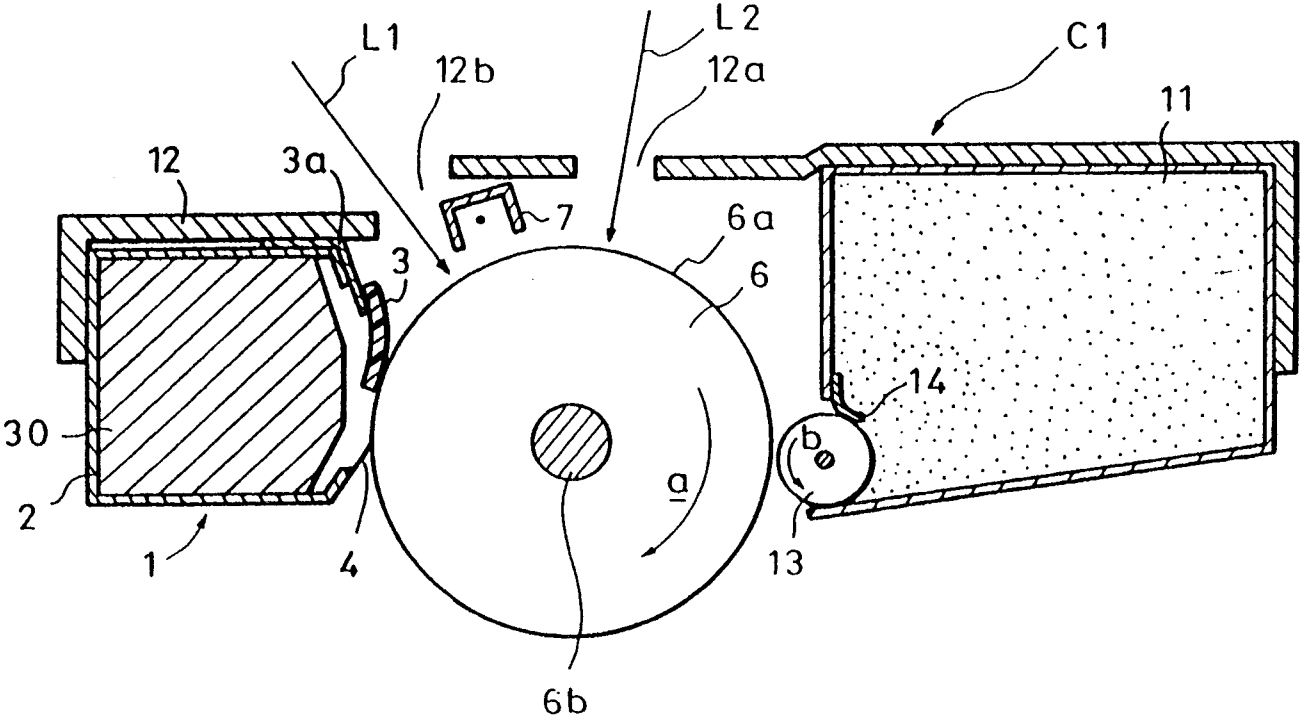
FIG. 5 is a sectional, side elevational view of a process cartridge incorporating a cleaning device embodying the present invention.

FIG. 5 is a schematic, sectional view of a process cartridge as an embodiment incorporating a cleaning device of the present invention. Referring to FIG. 5, the process cartridge, generally denoted by C1, has a casing 12 which encases as a unit a photosensitive drum 6 rotatable in the direction of the arrow a, a primary charger 7, a developing device 11 and a cleaning device 1. The casing 12 has an exposure slit 12*a* through which image light $L_2$ from an image light source (not shown) is applied to the surface 6*a* of the photosensitive drum 6 and a pre-exposure slit 12*b* through which a pre-exposure light $L_1$ is applied from a light source (not shown).

Figure 6:
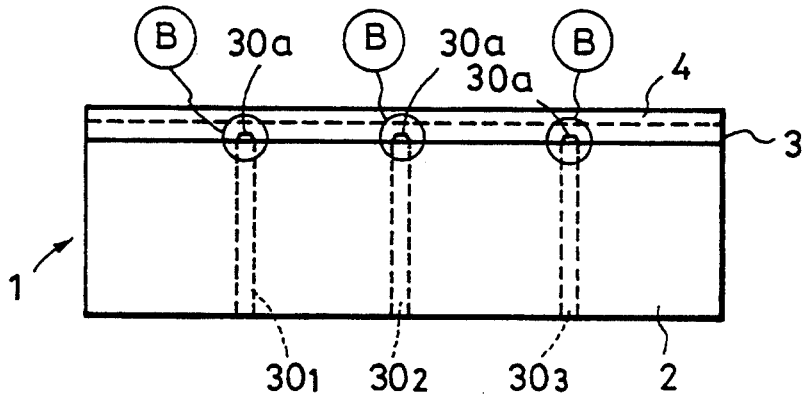
FIG. 6 is a plan view of the cleaning device.

FIG. 6 is a plan view of the cleaning device 1 incorporated in the process cartridge C1 shown in FIG. 5. Referring to FIG. 6, the cleaning device 1 has an elastic blade 3 and a plurality of, e.g., three, partition plates $30_1$, $30_2$, and $30_3$ (collectively denoted by reference numeral 30), which are injection-molded from a synthetic resin and which divide the space in the reservoir 2 into a plurality of sub-spaces. FIG. 7 illustrates, in a greater scale, each of portions marked by B in FIG. 6, i.e., the end 30*a* of each partition plate 30 facing the photosensitive drum 6. Arrows c indicate the flow of the developer collected from the photosensitive drum 6. Thus, the illustrated embodiment of the process cartridge has a housing 2 which forms the developer reservoir and whose internal space is divided by the partition plates 30 into a plurality of sub-spaces. The developer inlet end of the partition plates 30, i.e., the end facing the photosensitive drum 6, is progressively tapered towards the photosensitive drum 6. For instance, the intermediate portions of the partition plate 30 have a thickness of 3 mm and the thickness is progressively reduced at the end portion of the partition plate 30 adjacent to the developer inlet so as to provide a flat end surface 30*a* having a thickness which is small enough, 0.5 mm, for example, to prevent accumulation of the developer thereon. Thus, both side surfaces of the partition plate 30 converge at the end portion of the partition plate 30 adjacent to the developer inlet, as denoted by 30*b*, towards the flat end surface 30*a* of reduced thickness. It is not necessary to sharpen the end of the partition plate 30 to an extremely small thickness, provided that the thickness of the extreme end of the partition plate is small enough to prevent accumulation of the developer thereon. It will be seen that the cleaning device shown in FIGS. 5 through 7 offers the same advantages as those produced by the first embodiment.

Figure 8:
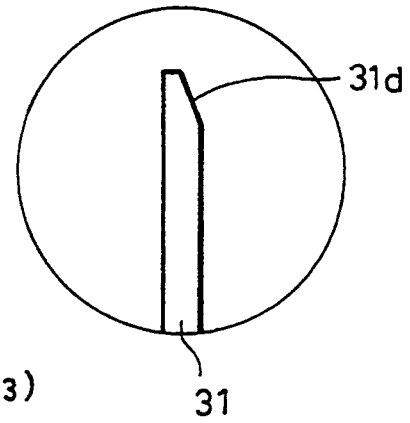
FIG. 8 is an enlarged view of an end portion of a partition member.

FIG. 8 shows an alternative example of the partition plate used in this embodiment of the process cartridge. In this case, the partition plate denoted by 31 is tapered only at its one side as at 31*d*, thus providing an end surface narrow enough to prevent accumulation of the developer.

Figure 7:
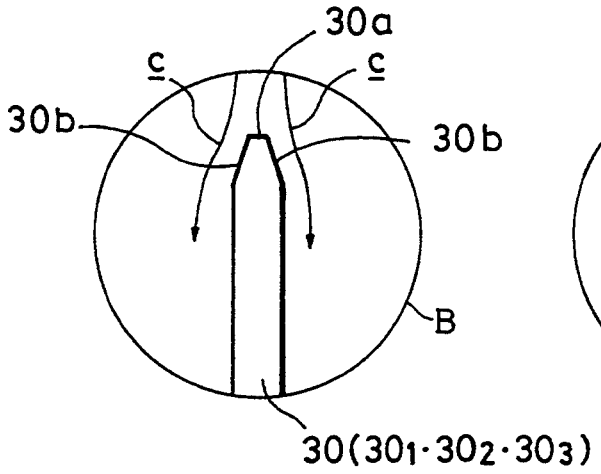
FIG. 7 is an enlarged view of a portion B shown in FIG. 6.

Although in FIGS. 5 through 7 the cleaning device is incorporated in a process cartridge, it will be clear that the same advantages as those described above can be obtained when the cleaning device is separate from other units or devices and independently incorporated in an image forming apparatus. Obviously, the described embodiment can be applied to a situation where a belt-type image carrier is used in place of the drum-shaped image carrier.

A description will now be given of another embodiment of the invention, with reference to FIGS. 9, 10 and 11.

Figure 9:
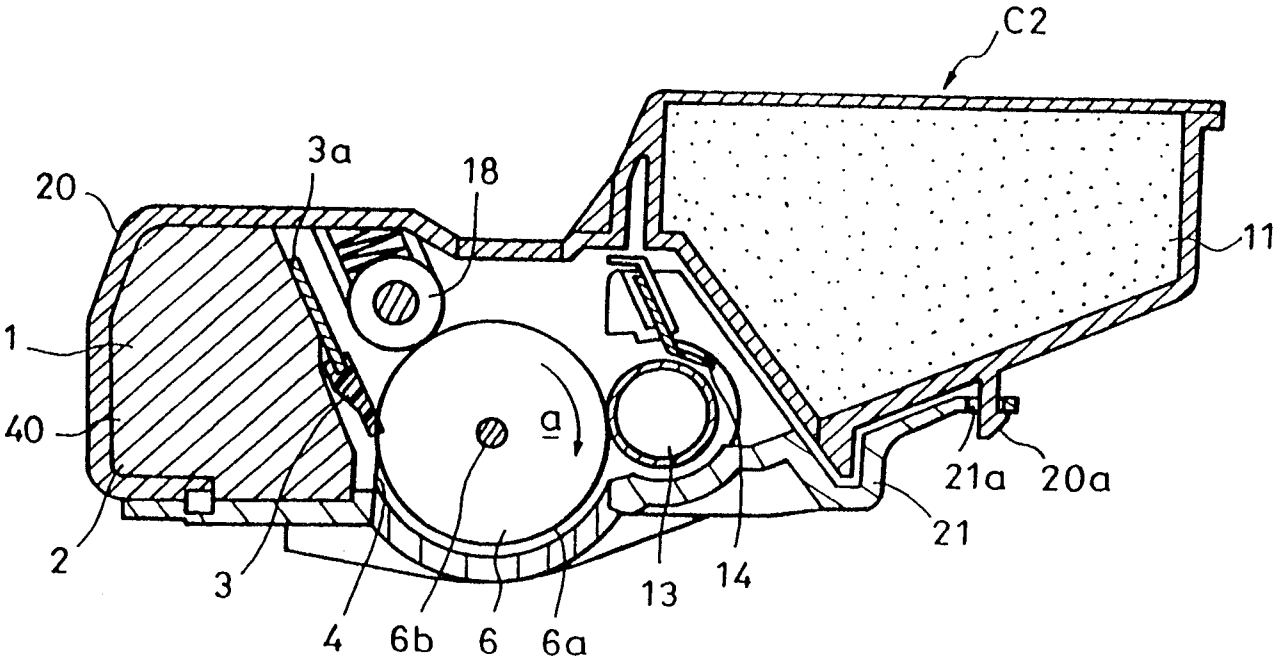
FIG. 9 is a sectional, side elevational view of a process cartridge incorporating a cleaning device embodying the present invention.

Referring to FIG. 9, a process cartridge C2 embodying the present invention has upper and lower casings 20 and 21, respectively, in which, assembled as a unit, are components or devices such as a photosensitive drum 6, an image carrier rotatable in the direction of the arrow a, a charging roller 18, a developing device 11 and a cleaning device 1. FIG. 10 is a plan view of the cleaning device 1 incorporated in the process cartridge C2 shown in FIG. 9. The cleaning device 1 has a developer reservoir 2, an elastic blade 3 and partition plates $40_1$, $40_2$, $40_3$ (collectively denoted by reference numeral 40) which are disposed in the developer reservoir 2. FIG. 11 is an enlarged view of an end portion of each partition plate 40 encircled by a circle C in FIG. 10. Arrows d show the flow of developer collected from the photosensitive drum 6.

In this embodiment, the casing of the process cartridge C2 is composed of upper and lower casings 20 and 21, respectively and partition plates 40 are provided in the lower casing 21. The partition plates 40 contact with the upper casing 20 so as to stiffen the latter. As will be seen from FIG. 11, each of the partition plates 40 provided in the lower casing 21 is progressively tapered towards the end where the developer enters, i.e., towards the photosensitive member 6, and each is rounded at its extreme end as at 40*a*. Numeral 20*a* denotes a retainer tab formed on the upper casing 20, while 21*a* denotes a retainer hole formed in the lower casing 21 which receives the retainer tab 20*a*, whereby the upper and lower casings 20, 21, respectively, are releasably secured to each other. It will be seen that, in this embodiment also, accumulation of the collected developer on the end of the partition plate 40 is avoided to ensure smooth collection of the developer, thus avoiding collection failure.

Figure 10:
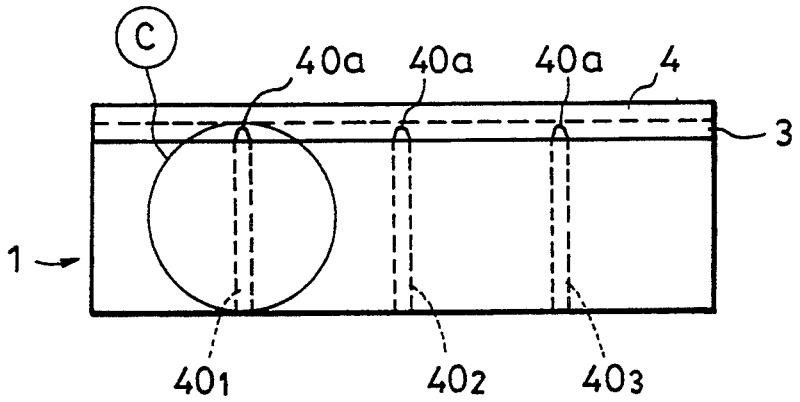
FIG. 10 is a plan view of the cleaning device.
Figure 11:
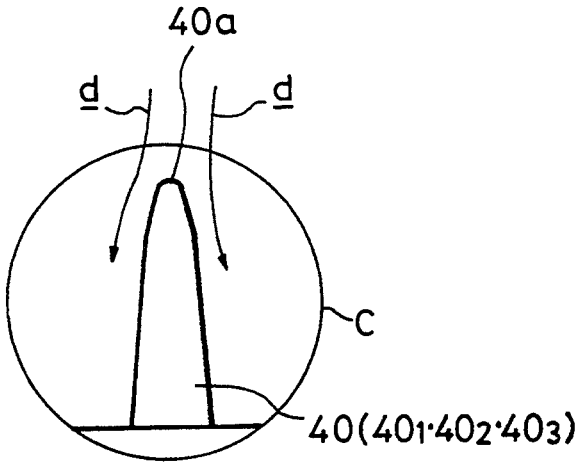
FIG. 11 is an enlarged view of a portion C shown in FIG. 10.

Although in the embodiment shown in FIGS. 9 through 11 the partition plates 40 are provided in the lower casing 21, this is not exclusive and the partition plates 40 may be provided in the upper casing 20 so as to contact with the lower casing 21, thus stiffening the lower casing 21.

Figure 12:
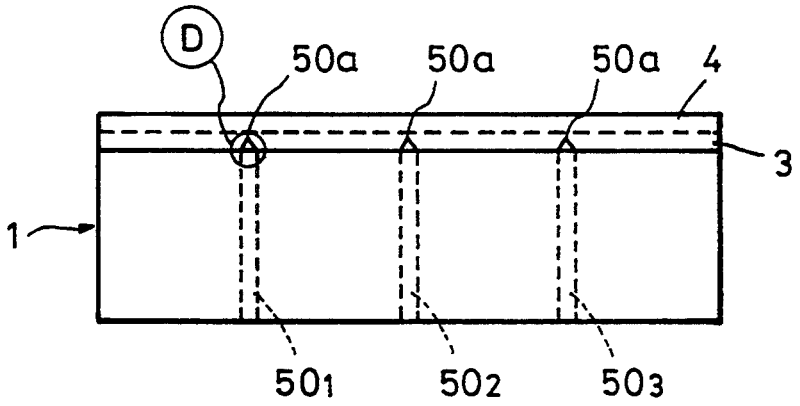
FIG. 12 is a plan view of a cleaning device embodying the present invention.
Figure 13:
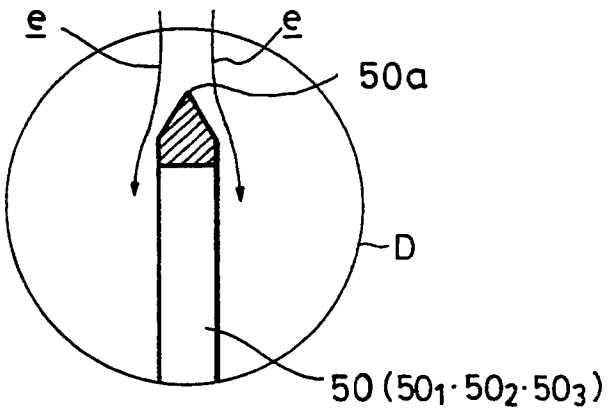
FIG. 13 is an enlarged view of a portion D shown in FIG. 12.

FIGS. 12 and 13 show another embodiment of the invention. In FIG. 12, a cleaning device generally denoted by reference numeral 1 has an elastic blade 3 and a plurality of partition plates $50_1$, $50_2$, $50_3$ (collectively denoted by reference numeral 50). FIG. 13 shows, in a greater scale, the end portion of one of the partition plates 50 marked by reference character D in FIG. 12. Arrows e indicate the flow of the collected developer. In order to ensure that the developer smoothly flows into the reservoir, it is preferable to sharpen the end of the partition plate 50 which is adjacent to the entrance for the developer and facing the drum, as in the case of the first embodiment shown in FIGS. 1 through 4. In general, however, sharpening of the ends of the partition plates 50 is not easy because the partition plates are formed integrally with the casing by injection molding. In this embodiment, therefore, a material which exhibits high fluidity, e.g., silicone rubber or urethane rubber, is used to form the end portions of the partition plates 50 during the molding, thus realizing a sharp edge at the end of the partition plate 50*a*, as shown in FIG. 13.

In this embodiment, therefore, it is possible to obtain any desired shape at the end portion of the partition plate, whereby smooth collection of the developer is attained to prevent any collection failure.

Figure 14:
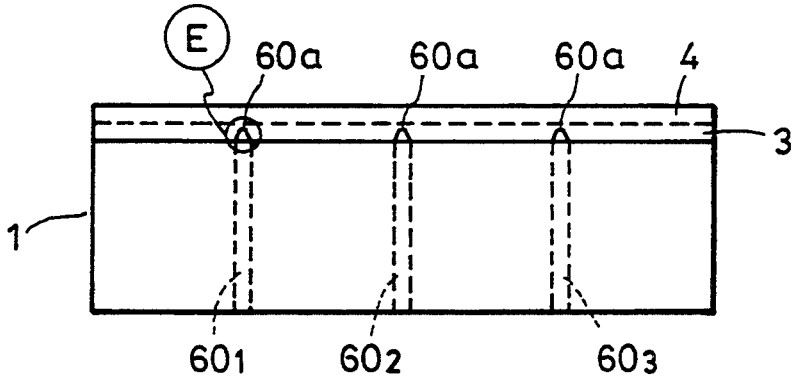
FIG. 14 is a plan view of a cleaning device embodying the present invention.
Figure 15:
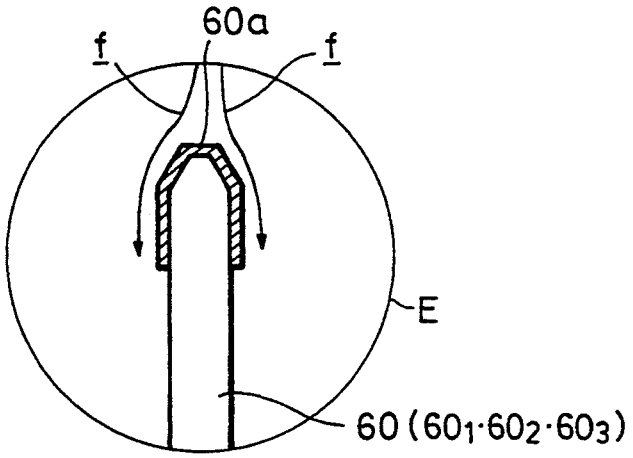
FIG. 15 is an enlarged view of a portion E shown in FIG. 14.

FIGS. 14 and 15 show another embodiment of the invention. Referring to FIG. 14, a cleaning device generally denoted by reference numeral 1 has an elastic blade 3 and a plurality of partition plates $60_1$, $60_2$, $60_3$ (collectively denoted by reference numeral 60). FIG. 15 shows, in a greater scale, the end portion of one of the partition plates 60 denoted by reference character E in FIG. 14. Arrows f indicate the flow of the collected developer.

In this embodiment, the tapered end portion of each partition plate 60 adjacent to the entrance for the developer, i.e., the end facing the photosensitive member 6, is provided with a material 60*a* such as a fluororesin, e.g., PTFE or PFA, which exhibits a small coefficient of friction to the toner used as the developer. The fluororesin material is attached by adhesion or coated on the tapered end portion of each partition plate, so as to ensure smooth flow of the toner into the reservoir 2 along the surfaces of the partition plates. Other low-friction materials such as a stainless steel, aluminum, or the like provide equivalent effects.

Figure 20:
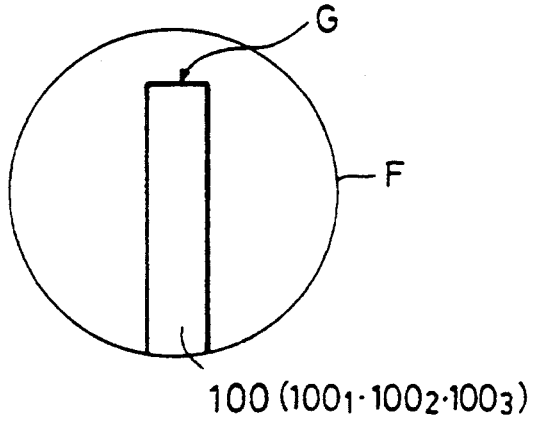
FIG. 20 PRIOR ART
FIG. 20 is an enlarged view of an end portion F of a partition plate shown in FIG. 19.

It is to be noted that the low-friction material attached by adhesion or coated on the tapered end portion of each partition plate results in an appreciable effect in smoothing the flow of the developer into the reservoir, even when such a material is applied to the end adjacent to the entrance for the developer, i.e., the end facing to the photosensitive drum, of the partition plates 100 used in the conventional cleaning device discussed above with reference to FIG. 20.

Figure 16:
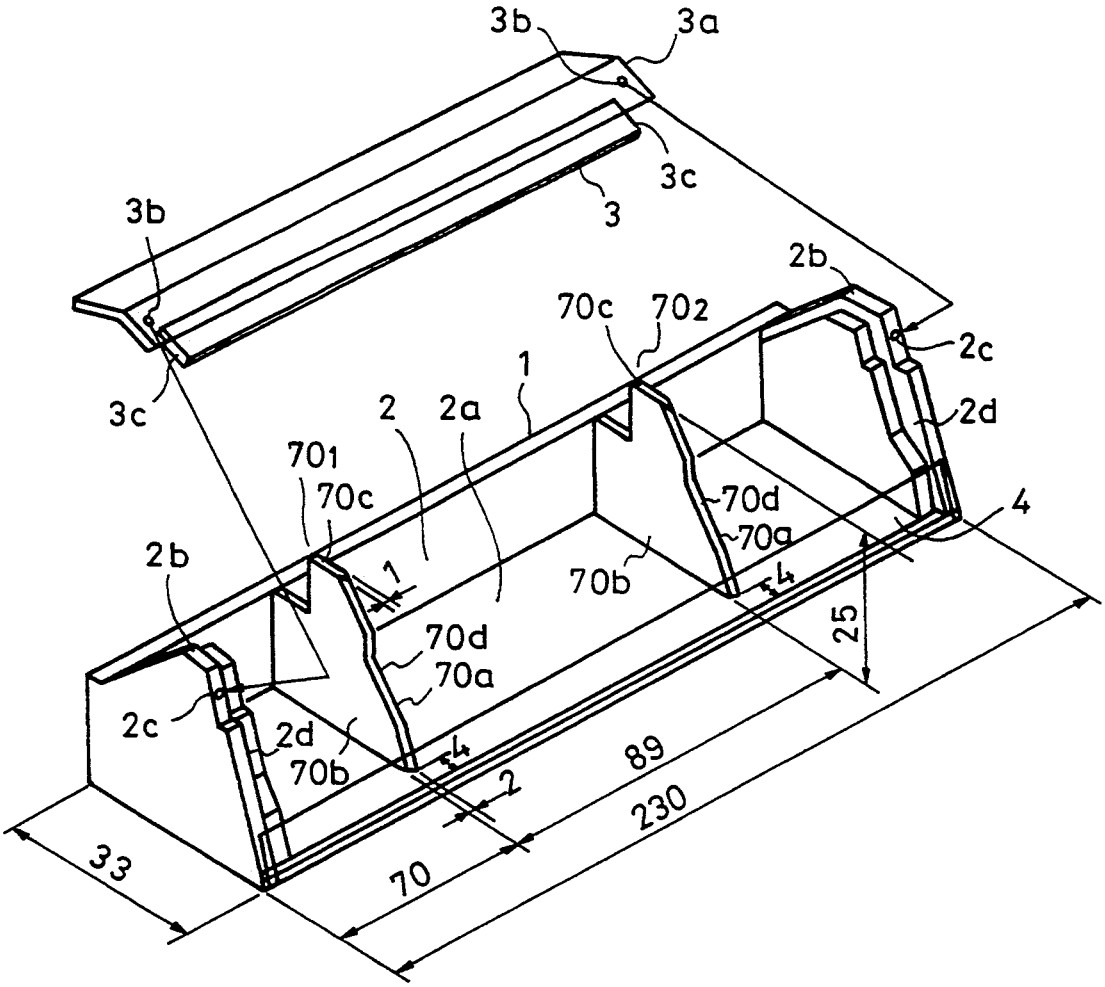
FIG. 16A is a perspective view of a cleaning device embodying the present invention;.
FIG. 16B is a sectional, side elevational view of the cleaning device shown in FIG. 16A.
Figure 16B:
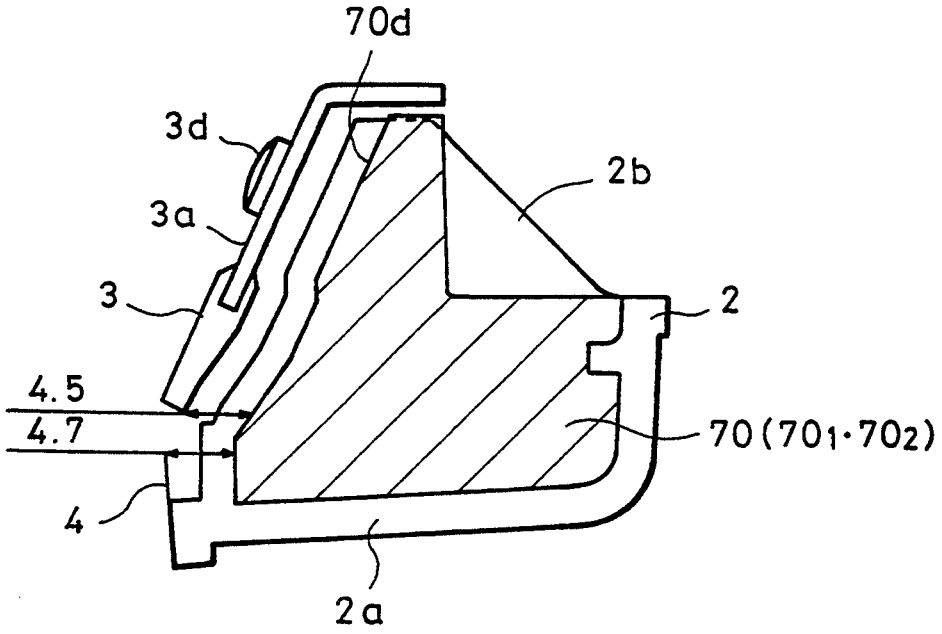

FIGS. 16A and 16B are a perspective view and a sectional, side elevational view, respectively, of another embodiment of the cleaning device in accordance with the present invention.

This embodiment employs a pair of partition plates $70_1$, $70_2$ (collectively denoted by reference numeral 70) in a reservoir 2 for collected toner. The portion of the partition plates 70 facing the photosensitive drum 6 is shaped in conformity with the inclination of the cleaning blade 3 with respect to the photosensitive drum 6, thus providing a greater effect in limiting the movement of the collected developer inside the reservoir 2. The thickness of each partition plate 70 is varied so that the thickness is about 2 mm at the base end of the plates 70 on the bottom wall 2*a* of the reservoir 2 and about 1 mm at the upper end. Thus, in this embodiment, the portion of the partition plate 70 facing the cleaning blade 3 has a thickness smaller than the portion of the partition plate which confronts the guide member 4. Furthermore, the edges 70*d* of the partition plates 70 facing the photosensitive drum 6 are rounded in an arcuate form. However, edges 70*d* of the partition plates 70, may have any one of the shapes employed in the preceding embodiments which is desired.

Thus, in the embodiment shown in FIGS. 16A and 16B, the partition plate is shaped substantially in conformity with the cross-sectional shape of the space inside the reservoir 2, thus providing a greater effect in prevention of free movement of the developer in the reservoir 2.

In each of the embodiments described hereinbefore, the fixing of the cleaning blade 3 to the wall of the reservoir 2 may be done by driving screws 3*d* into aligned holes 3*b* and 2*c* which are formed, respectively, in the holder 3*a* and in the side wall 2*b* of the reservoir 2. With this arrangement, each end 3*c* of the cleaning blade 3 abuts the inner side surface 2*d* of the side wall 2*b*, so as to prevent leakage of the developer from any gap which may otherwise be formed on each end of the blade. The guide member 4 may be bonded to the bottom wall 2*a* of the reservoir 2 by means of a bonding agent or an adhesive tape. In the embodiment shown in FIGS. 16A and 16B, the reservoir 2 and the partition plates 70 are integrally formed from, for example, a high-impact strength styrol (HISP).

The dimensions of various portions are shown below by way of example.

| | | | |
|---|---|---|---|
| (1) | Depth of reservoir: | ≈ | 33 mm |
| (2) | Width of the reservoir: | ≈ | 230 mm |
| (3) | Height of partition plates 70: | ≈ | 25 mm |
| (4) | Distance between partition plates $70_1$ and $70_2$: | ≈ | 89 mm |
| (5) | Distance between side wall 2b and partition plate 70: | ≈ | 70 mm |
| (6) | Thickness of upper end of partition plate 70: | ≈ | 1 mm |
| (7) | Thickness of lower end of the partition plate 70: | ≈ | 2 mm |
| (8) | Distance between end 70a of the partition plate and bottom wall 2a of reservoir 2: | ≈ | 4 mm |
| (9) | Distance between end 70d of partition plate and end of blade 3: | ≈ | 4 mm |
| (10) | Distance between end 70d of the partition plate and the end of the guide member 4: | ≈ | 4.7 mm |

A description now will be given of an embodiment of the image forming apparatus of the present invention which incorporates a cleaning device embodying the present invention.

Figure 17:
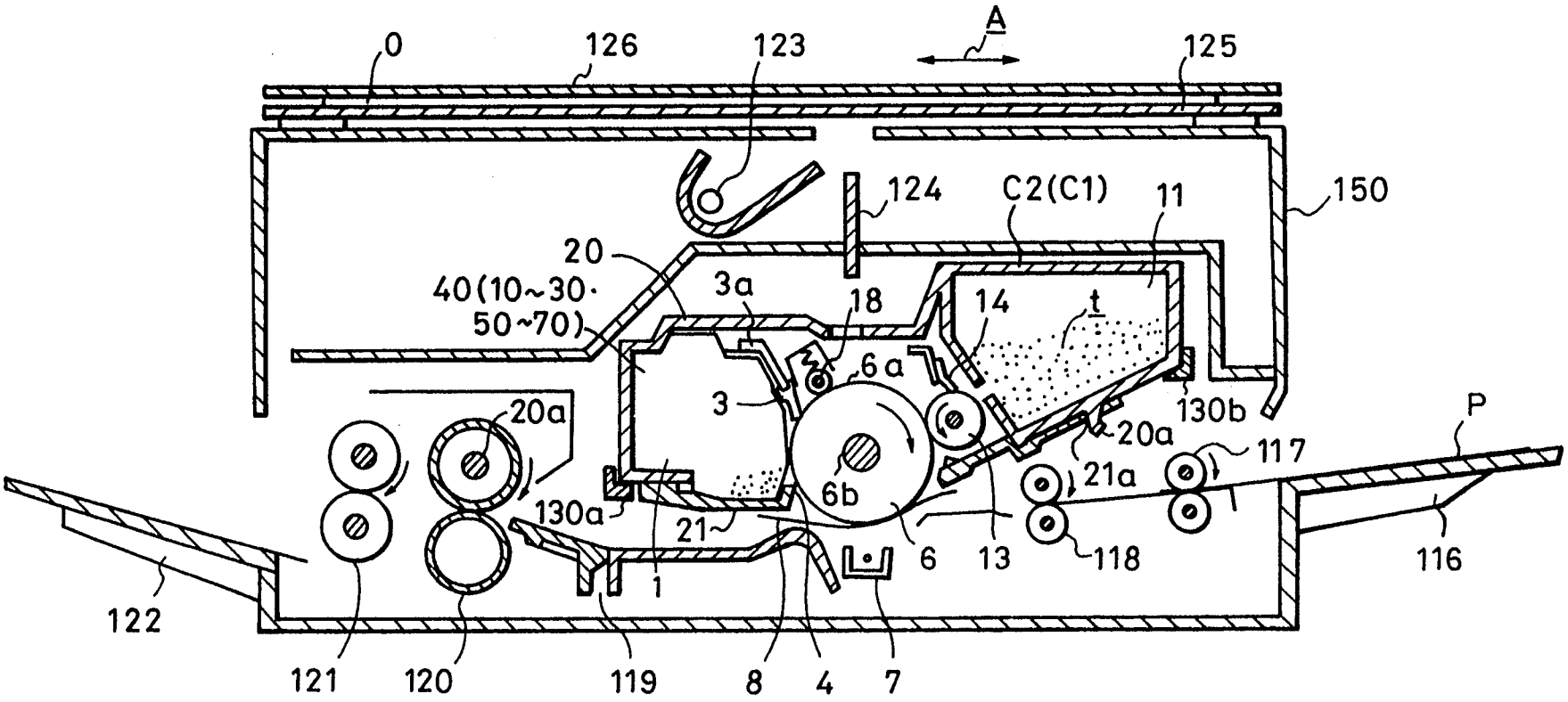
FIG. 17 is a sectional, side elevational view of an image forming apparatus incorporating a cleaning device embodying the present invention.
Figure 18:
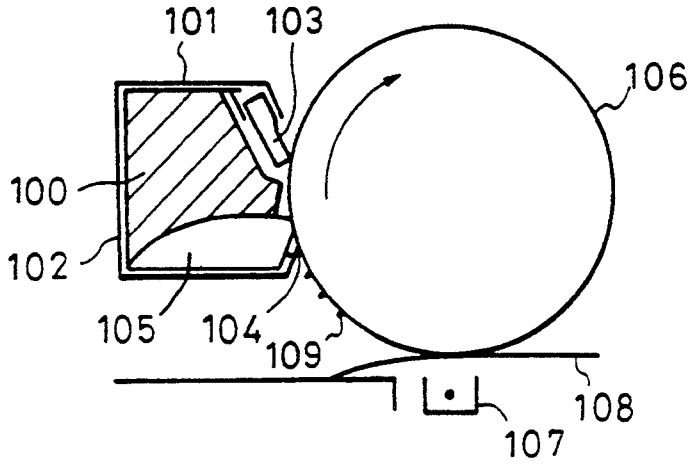
FIG. 18 PRIOR ART
FIG. 18 is a fragmentary, sectional view of an electrophotographic apparatus incorporating a conventional cleaning device.
Figure 19:
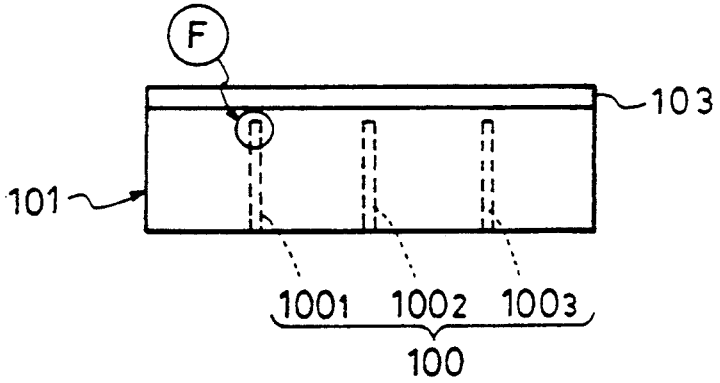
FIG. 19 PRIOR ART
FIG. 19 is a plan view of a conventional cleaning device with a conventional partition plate.

FIG. 17 is a sectional side elevational view of an electrophotographic copying apparatus of the present invention as an embodiment of the image forming apparatus of the present invention. The image forming apparatus incorporates a process cartridge which embodies the present invention and, hence, incorporates a cleaning device of the present invention.

Referring to FIG. 17, various process means such as a developing device 11, a charger 18 and a cleaning device 1 are arranged around a photosensitive drum 6 which serves as an image carrier. The photosensitive drum 6 and the processing means are assembled together in a process cartridge casing that is composed of upper and lower casings 20 and 21, respectively, made from a plastic, thus forming a process cartridge of the same type as the process cartridge C2 or C1 described above. The process cartridge can be handled as a unit thus facilitating maintenance. A transfer charger 7 is disposed in the image forming apparatus at a position below the photosensitive drum 6. A paper feed tray 116, a paper feed roller 117, and a register roller 118 are disposed on the upstream side of the transfer charger 7 as viewed in the direction of movement of the paper onto which an image is to be transferred from the photosensitive drum 6. A paper guide 119, a fixing device 120, a paper ejection roller 121, and a paper ejection tray 122 are disposed on the downstream side of the transfer charger 7 as viewed in the direction of movement of the paper.

An illuminating lamp 123 for illuminating an original O is disposed above the process cartridge. Light from the illuminating lamp 133 is reflected by the original O and is focused onto the surface of the photosensitive drum 6 through a short-focus optical device array 124 which also is disposed above the process cartridge. A reciprocating original table 125 is disposed on the top of the body 150 of the apparatus so as to move reciprocatingly in the direction of the arrow A. Numeral 126 designates an original pressing plate.

In operation, the light from the illuminating lamp 123 is reflected by the original O and is made to impinge, through the short-focus optical device array 124, upon the photosensitive drum 6 which has been uniformly charged by the charger 18, whereby an electrostatic latent image corresponding to the image information on the original O is formed on the photosensitive drum 6. The electrostatic latent image is then moved in accordance with the rotation of the photosensitive drum 6 to a position where it faces the developing device 11 which supplies a toner t to develop the latent image into a visible toner image. Meanwhile, a transfer paper 8 is fed into the nip between the photosensitive drum 6 and the transfer charger 7 from the paper fed tray 116 and the paper fed roller 117, while being registered with the developed image by the register roller 118. The transfer charger 7 is then activated to electrostatically transfer the toner image from the photosensitive drum 6 onto the transfer paper 8. The transfer paper 8 now carrying the toner image transferred thereto is fed into the fixing device 120 so that the transferred toner image is permanently fixed to the transfer paper 8. The paper 8 carrying the fixed image is ejected by the ejecting roller 121 onto the ejection tray 122. Following the transfer of the image, the transfer portion of the surface of the photosensitive drum 6 is moved to the position where the cleaning device 1 is disposed and any residual toner remaining on the surface of the photosensitive drum 6 is removed by the cleaning device 1. Numerals 130*a*, 130*b* denote guides which guide the process cartridge when the cartridge is mounted in the apparatus.

Although an electrophotographic copying machine incorporating a process cartridge has been described, it is to be understood that the cleaning device of the invention can be used in image forming apparatuses of the type which do not employ any process cartridge.

The term "process cartridge" is used in this specification to mean a cartridge in which charging means, developing means or a cleaning means is assembled together with an electrophotographic photosensitive member. The process cartridge is detachably mounted on an image forming apparatus such as a copying machine or a laser beam printer. Thus, the process cartridge is a component that is detachably mounted on an image forming apparatus, such as a copying machine or a laser beam printer, and which incorporates at least one of charging means, developing means, and cleaning means assembled together with an electrophotographic photosensitive member. Thus, the simplest form of the process cartridge employs a developing means assembled together with an electrophotographic photosensitive member.

As described in the present invention, the partition members are required only to effectively suppress the movement of the developer in the reservoir. Thus, the partition members need only partially partition the space inside the reservoir.

Furthermore, although the invention provides superior results when used for developers having very small particle sizes, e.g., 3 to 7 μm, it is to be understood that the invention can be applied also to apparatuses which use developers of greater sizes.

As will be understood from the foregoing description, according to the present invention, it is possible to obtain a cleaning device which can improve image quality through prevention of cleaning failure, as well as to obtain a process cartridge and an image forming apparatus incorporating such a cleaning device.

The present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A cleaning device for cleaning a surface of an image carrier, comprising:

cleaning means for removing residual developer from the surface of said image carrier;

developer receiving means for receiving the residual developer removed by said cleaning means; and at least one partition member partitioning a space inside said receiving means and arranged such that an end of said partition member facing said image carrier has a smaller thickness than other portions of said partition member.

2. A cleaning device according to claim 1, wherein a thickness of said partition member is progressively reduced towards said image carrier.

3. A cleaning device according to claim 1, wherein at least an end of said partition member facing said image carrier is made from a material which exhibits a small coefficient of friction with respect to the residual developer.

4. A cleaning device according to claim 3, wherein said material is a fluororesin.

5. A cleaning device according to claim 3, wherein the end of said partition member facing said image carrier is rounded.

6. A process cartridge adapted to be detachably mounted on an image forming apparatus, comprising:

an image carrier;

cleaning means for removing residual developer from a surface of said image carrier;

developer receiving means for receiving the residual developer removed by said cleaning means; and at least one partition member partitioning a space inside said receiving means and arranged such that an end of said partition member facing said image carrier has a smaller thickness than other portions of said partition member.

7. A process cartridge according to claim 6, wherein said partition member extends in a direction which crosses an axis of rotation of said image carrier.

8. A process cartridge according to claim 6, wherein a thickness of said partition member is progressively reduced towards said image carrier, so as to suppress accumulation of the residual developer thereon.

9. A process cartridge according to claim 6, wherein at least an end of said partition member facing said image carrier is made from a material which exhibits a small coefficient of friction with respect to the residual developer, so as to suppress accumulation of the residual developer thereon.

10. A process cartridge according to claim 9, wherein said material is a fluororesin.

11. A process cartridge according to claim 6, wherein said receiving means includes a collecting reservoir which receives, through an opening formed in a wall thereof, the residual developer removed from said image carrier by said cleaning means.

12. A process cartridge according to claim 11, wherein said cleaning means further includes a cleaning blade as said cleaning means attached to a portion of said collecting reservoir and a guiding member which guides the residual developer removed from said image carrier into said collecting reservoir.

13. An image forming apparatus, comprising:

a process cartridge, comprising:

an image carrier;

cleaning means for removing residual developer from a surface of said image carrier;

developer receiving means for receiving the residual developer removed by said cleaning means; and at least one partition member partitioning a space inside said receiving means and arranged such that an end of said partition member facing said image carrier has a smaller thickness than other portions of said partition member;

means for detachably mounting said process cartridge; and conveyor means for conveying a recording medium.

14. An image forming apparatus according to claim 13, wherein said apparatus is a laser beam printer.

15. An image forming apparatus according to claim 13, wherein said apparatus is an electrophotographic copying machine.

16. An image forming apparatus for forming an image on a recording medium, comprising:

an image carrier;

image forming means for forming an image on said image carrier;

cleaning means for removing any residual developer after transfer of an image formed by said developer on said image carrier from said image carrier to the recording medium;

developer receiving means for receiving the residual developer removed by said cleaning means; and at least one partition member partitioning a space inside said receiving means and arranged such that an end of said partition member facing said image carrier has a smaller thickness than other portions of said partition member.

17. An image forming apparatus according to claim 16, wherein said apparatus is a laser beam printer.

18. An image forming apparatus according to claim 16, wherein said apparatus is an electrophotographic copying machine.

19. A cleaning device, comprising:

a collecting reservoir for receiving matter collected from an object to be cleaned; and at least one movement limiting member provided in said collecting reservoir, partitioning a space inside said collecting reservoir, and being capable of suppressing movement of the received matter in said collecting reservoir, said movement limiting member having a cross-sectional area progressively decreasing towards the object to be cleaned.

20. A cleaning device, comprising:

a collecting reservoir for receiving matter collected from an object to be cleaned; and at least one movement limiting member provided in said collecting reservoir, partitioning a space inside said collecting reservoir, and being capable of suppressing movement of the received matter in said collecting reservoir, at least an end portion of said movement limiting member adjacent the object to be cleaned being made of a material having a small coefficient of friction.

21. A process cartridge according to claim 6, further comprising an electrostatic charging means for electrifying said image carrier.

22. A process cartridge according to claim 6, further comprising a developing means for developing a latent image formed on said image carrier.

* * * * *